US009249789B2

(12) United States Patent
Kashyap et al.

(10) Patent No.: US 9,249,789 B2
(45) Date of Patent: Feb. 2, 2016

(54) PIPE PUMP SYSTEM

(76) Inventors: Ravindra Kashyap, Brooklyn, NY (US); Govind Sahu, Brooklyn, NY (US)

( * ) Notice: Subject to any disclaimer, the term of this patent is extended or adjusted under 35 U.S.C. 154(b) by 32 days.

(21) Appl. No.: 13/269,011

(22) Filed: Oct. 7, 2011

(65) Prior Publication Data

US 2012/0087809 A1 Apr. 12, 2012

Related U.S. Application Data

(60) Provisional application No. 61/391,234, filed on Oct. 8, 2010.

(51) Int. Cl.

| | |
|---|---|
| ***F04B 23/00*** | (2006.01) |
| ***F04B 43/09*** | (2006.01) |
| ***F04B 19/20*** | (2006.01) |
| ***F04B 43/08*** | (2006.01) |

(52) U.S. Cl.

CPC ..... *F04B 23/00* (2013.01); *F04B 19/20* (2013.01); *F04B 43/08* (2013.01); *F04B 43/084* (2013.01); *F04B 43/09* (2013.01); *F04B 43/095* (2013.01)

(58) Field of Classification Search

CPC ..... F04B 17/02; F04B 23/00; F04B 43/09; F04B 43/095

USPC ..... 417/410.1, 322, 474, 411, 412, 478; 433/80, 88

See application file for complete search history.

(56) References Cited

U.S. PATENT DOCUMENTS

| | | | | |
|---|---|---|---|---|
| 3,195,537 | A | | 7/1965 | Blasi |
| 3,401,690 | A | | 9/1968 | Martin |
| 3,405,710 | A | | 10/1968 | Kovach |
| 3,452,745 | A | | 7/1969 | Hutchinson et al. |
| 3,465,751 | A | | 9/1969 | Powers |
| 3,547,110 | A | * | 12/1970 | Balamuth ..... 601/162 |
| 3,561,433 | A | | 2/1971 | Kovach |
| 3,566,869 | A | | 3/1971 | Crowson |
| 3,731,675 | A | | 5/1973 | Kelly |
| 3,800,786 | A | | 4/1974 | Kovach |
| 4,164,940 | A | | 8/1979 | Quinby |
| 4,236,889 | A | | 12/1980 | Wright |
| 4,331,422 | A | | 5/1982 | Heyman |
| 4,400,147 | A | | 8/1983 | Springer et al. |
| 4,412,823 | A | | 11/1983 | Sakai et al. |
| 4,524,790 | A | | 6/1985 | Kelley et al. |
| 4,619,009 | A | | 10/1986 | Rosenstatter |
| 4,862,876 | A | | 9/1989 | Lih-Sheng |
| 4,903,688 | A | | 2/1990 | Bibby et al. |
| 4,991,570 | A | | 2/1991 | Bullard |
| 5,013,241 | A | | 5/1991 | von Gutfeld et al. |
| 5,062,413 | A | | 11/1991 | Bullard |

(Continued)

*Primary Examiner* — Devon Kramer

*Assistant Examiner* — Patrick Hamo

(74) *Attorney, Agent, or Firm* — Carter, DeLuca, Farrell & Schmidt, LLP

(57) ABSTRACT

Disclosed is an embodiment that introduces a novel system to pump fluids, or, gases or, semi-solids, or, solids, from one place to another. Conventionally, a motorized pump systems are used to pump any given fluid from one position to another, nonetheless, in this invention not only a new system of pumping fluids is so introduced, but, existing functions of a conventional motorized pumping systems are saliently augmented by the pipe pump system. The pipe pump functions basically, by a series of electromagnets, that are placed around a flexible and resilient tube, (a rubber tube, for instance), and when these said electromagnet arrangements are actuated, then, that causes the pipe pump to pump out fluids, by squeezing on the fluids, or gases, contained within.

12 Claims, 12 Drawing Sheets

(56) References Cited

U.S. PATENT DOCUMENTS

| | | | | |
|---|---|---|---|---|
| 5,098,291 | A | 3/1992 | Curtis et al. | |
| 5,142,723 | A | 9/1992 | Lustig et al. | |
| 5,570,709 | A | 11/1996 | Haddad et al. | |
| 5,573,398 | A | 11/1996 | Towie et al. | |
| 5,667,382 | A | 9/1997 | Holland | |
| 5,697,784 | A | 12/1997 | Hafele et al. | |
| 5,853,290 | A | 12/1998 | Winston | |
| 5,860,942 | A | 1/1999 | Cox | |
| 6,074,179 | A * | 6/2000 | Jokela et al. | 417/322 |
| 6,164,967 | A | 12/2000 | Sale et al. | |
| 6,174,164 | B1 | 1/2001 | Masjedi | |
| 6,183,231 | B1 | 2/2001 | Van Norman | |
| 6,217,327 | B1 | 4/2001 | Bedi | |
| 6,299,443 | B1 | 10/2001 | Gerstner et al. | |
| 6,375,459 | B1 | 4/2002 | Kamen et al. | |
| 6,602,071 | B1 | 8/2003 | Ellion et al. | |
| 6,893,259 | B1 | 5/2005 | Reizenson | |
| 7,789,583 | B2 | 9/2010 | Kuo | |
| 7,993,067 | B2 | 8/2011 | Hall et al. | |
| 8,052,627 | B2 | 11/2011 | Gromer et al. | |
| 8,197,234 | B2 * | 6/2012 | Gharib et al. | 417/322 |
| 2003/0204155 | A1 | 10/2003 | Egeresi | |
| 2004/0197733 | A1 | 10/2004 | Karapetyan | |
| 2005/0275494 | A1 * | 12/2005 | Gharib et al. | 335/220 |
| 2006/0292521 | A1 | 12/2006 | Hegemann | |
| 2007/0184404 | A1 | 8/2007 | Johnki | |
| 2008/0254408 | A1 | 10/2008 | Coates | |
| 2009/0078290 | A1 | 3/2009 | Addicks et al. | |
| 2009/0100620 | A1 | 4/2009 | Gatzemeyer et al. | |
| 2009/0208898 | A1 | 8/2009 | Kaplan | |
| 2010/0062397 | A1 | 3/2010 | Brewer | |
| 2010/0143863 | A1 | 6/2010 | Lin | |
| 2010/0261134 | A1 | 10/2010 | Boyd et al. | |
| 2011/0072605 | A1 | 3/2011 | Steur | |
| 2011/0076090 | A1 | 3/2011 | Wu et al. | |
| 2011/0207077 | A1 | 8/2011 | Janssen et al. | |
| 2011/0225759 | A1 | 9/2011 | Fleuren | |
| 2011/0229844 | A1 | 9/2011 | Chan | |
| 2011/0252584 | A1 | 10/2011 | Jousma et al. | |

* cited by examiner

PIPE PUMP SYSTEM

PRIORITY

The present application claims priority to a U.S. provisional patent application filed on Oct. 8, 2010 and assigned U.S. Provisional Patent Application Ser. No. 61/391,234; the entire contents of which are incorporated herein by reference.

BACKGROUND

Unlike a motor pump system, a novel pump system, the pipe pump, is so described, wherein, a tubular pipe structure act as its own pump in maintaining the flow of any given fluids (or gases, or, semi-solids, or, even solids) through itself. The fluid flow occurs due to the presence of the actuator enclosed within the walls of the pipe pump. Therefore, the need for a big, bulky, space occupying, motor pump systems for making fluid flow possible in a given pipe may not be necessary, if the pipe pump device is substituted instead. Or, the flow of fluids in any given tube or pipe could be further augmented by the combination of motorized pump system and the pipe pump system. More so, the converse arrangements of the pipe pump system yields an electricity generator pipe system which is described, as well.

SUMMARY

So, the pipe pump is a flexible and resilient pipe (or, tube), which is actuated by a set of actuators, that surrounds the wall of the said pipe and causes any fluid contained within its boundaries to be pumped out. (And these actuators can be electromagnets, piezoelectric crystal arrangements, or any combinations, thereof.) Hence, the pipe pump itself can function as a "stand alone pump", or, the pipe pump can augment the pumping function of any motorized pump system. The pipe pump can be applied in many fields, like transporting oil over long distances, pumping water within a building or a house, or, pumping fluids like blood, semi solid food, liquefied food, etc., within a biological entity, animals, humans, alike, or, pumping any fluid whatsoever from one spatial location to another. The scope of application for the pipe pump is countless. In addition to the basic function of pumping, the pipe pump fluids can be heated and cooled. Electromagnetic radiation, or, other fluids, chemicals can be added to the initial fluid within the pipe pump, and detectors, sensors, (pressure, flow, and temperature sensors, for instance), can be made part and parcel of the pipe pump system. More so, turbine or fan blades can be introduced inside the pipe pump that will further enhance the pumping action of the pipe pump system. By changing the radial caliber of the pipe pump system can also yield changes in the rate of flow and changes in the pressure of the fluids flowing across the pipe pump device. In applications where the rate of flow of fluids, and, or, rate of change of the pressure of the fluid, are both highly variable, and needed, herein, the pipe pump can be very useful device to implement. Now, the pumped out fluids in the pipe pump system will carry away the heat and, or, the thermal energy with it, thus cooling the heated actuators of the pipe pump system. This allows the pipe pump actuators to work longer without being damaged or destroyed by thermal energy as compared to motorized pump systems. Lastly, the converse arrangements of the pipe pump actuators can yield into another novel device, which is the electricity generator pipe system, made operable, (i.e., the device produces electricity), only when, discontinuous, and perturbative, flow, pressure, and, or, volume of fluids are present at variable rates, and, or, variable quantities, within such a pipe generator system.

DETAILED DESCRIPTION

The Pipe Pump System

Figure 1:
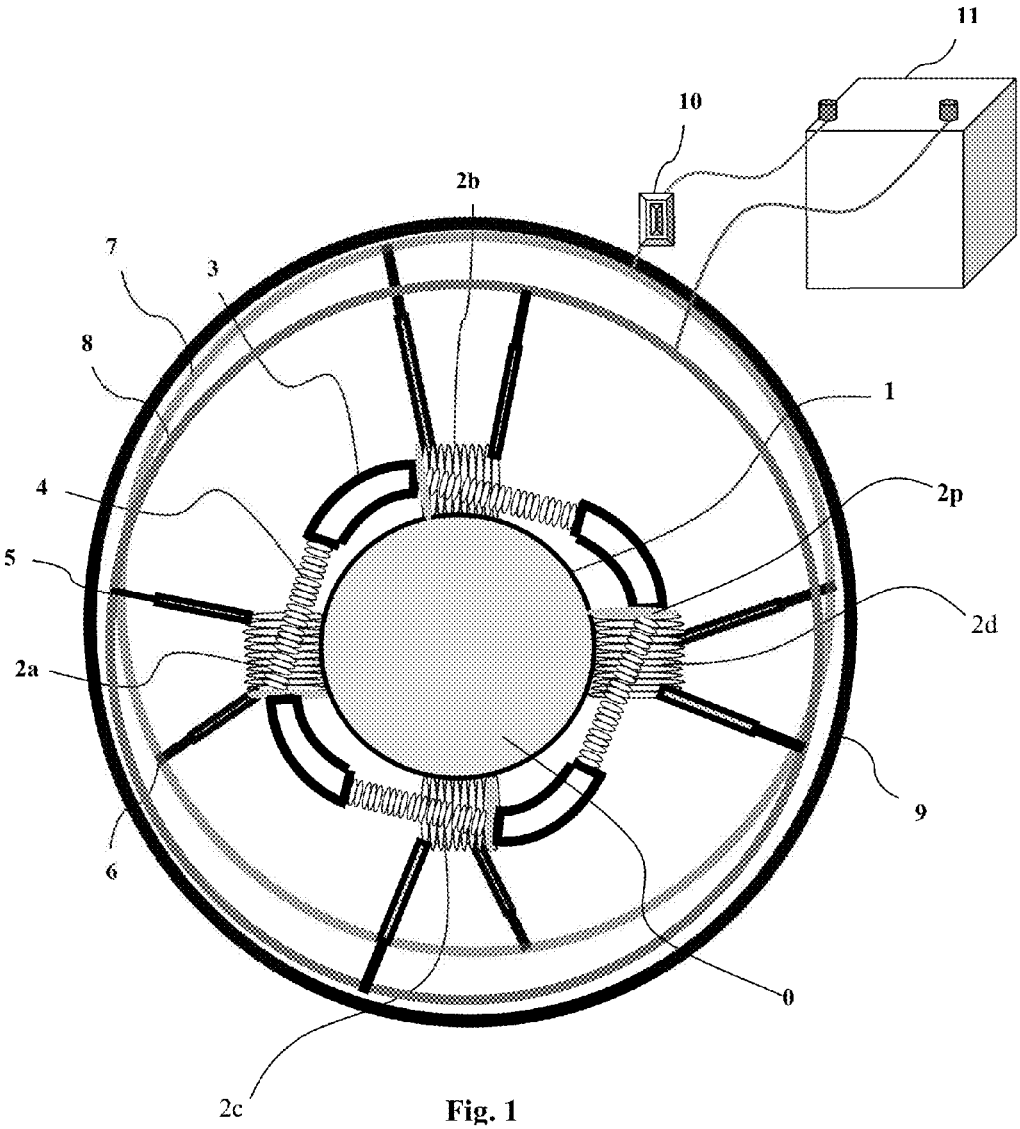
FIG. 1 Shows the embodiment of the pipe pump, wherein, a set of electromagnets surround a flexible and resilient tube and these said electromagnets are supplied with power from a battery source through specially designed metallic contact points.

A flexible and resilient rubber pipe (or, any other material making up a pipe, or, a tube), 1, is surrounded by a special circularly configured set of magnets (or, electromagnets, or, electromagnet coil windings), 3, as in FIG. 1. And these magnets, 3, contract by inserting into the hollow space of the metallic wire coil windings, 2*a*, 2*b*, 2*c*, 2*d*, when the current is given to the said coil windings, 2*a*, 2*b*, 2*c*, 2*d*, FIG. 1. Now, one side of the magnet, 3, is permanently affixed to a solid plate, 2*p*, (can be a non-conductor), situated on the non hollow side of the metallic coil winding, 2*a*, 2*b*, 2*c*, 2*d*, FIG. 1. The other side of the magnet, 3, is affixed to a spring (compression spring for instance), 4, and this spring is affixed to the non conducting base plate, 2*p*, which resides in the hole of the coil windings, 2*a*, 2*b*, 2*c*, 2*d*, FIG. 1. Note that in FIG. 1, the four circularly configured magnets, 3, with four circularly configured compression spring, 4, and four circularly configured metallic wire coil windings, (2*a*, 2*b*, 2*c*, 2*d*), all of which are affixed to each other in a singular closed loop arrangement form a magnet-coil assembly. Note that contained inside the flexible tube, 1, are the fluids, (or, gases, or, semi-solid, or, solids, or, or, plasma, or, even electromagnetic waves, etc.), 0, FIG. 1. (If electromagnetic waves, or, lasers, are the constituents in place of fluids, 0, within the flexible pipe, 1, of the pipe pump apparatus, then the inner layer of the flexible pipe, 1, can be coated with any number of "fiber optic" materials with a given refractive index, so as to not allow the electromagnetic waves, or, lasers, to escape from such a pipe pump system). The coil winding, 2*a*, 2*b*, 2*c*, 2*d*, has two sturdy, positive and negative terminal metallic electrodes, 5 and 6, like entities jutting out of it, as in FIG. 1. These electrodes, 5 and 6, come in contact with a set of negative and positive circularly arranged metallic wire terminals, 7 and 8, FIG. 1. These conducting terminals, 7 and 8, are stabilized and affixed to a non conducting strong rigid cylindrical ringed encasing, 9, FIG. 1. The terminals, 7 and 8, are further connected to a set of wires, emanating from a power source like a battery, 11, FIG. 1. There is a switch, 10, connected between the battery, 11, and the terminal, 7, FIG. 1. (Now the entity, 10, can also contain within itself, an Inverter, Programmable Logic Controller, inductor, capacitor, motherboard, microchip, microprocessor, and, or, a resistor.)

Now, the magnets, 3, the springs, 4, the metallic coil windings, 2*a*, 2*b*, 2*c*, 2*d*, the strong electrodes, 5, 6, and the circularly arranged metallic contact points, 7, 8, can be of any shape and size, that is different from the design of FIG. 1. So, when the switch, 10, is turned, "on", the current will flow from the battery into the circularly arranged metallic contact points, 7 and 8, FIG. 1. From the conducting entity, 7 and 8, the current flows into the conducting negative and positive electrodes, 5 and 6, thus, supplants the metallic wire coil windings, 2*a*, 2*b*, 2*c*, 2*d*, with electric current, FIG. 1. The current inside the coil windings, 2*a*, 2*b*, 2*c*, 2*d*, yields a magnetic field such that an attractive electromagnetic force will be experienced by the permanent magnets, 3, FIG. 1. At this time, the magnets, 3, pushes and squeezes the non-conducting compression spring, 4, into the hole of the coil winding, 2*a*, 2*b*, 2*c*, 2*d*, against the non conducting base plate, 2*p*, FIG. 1. Since all four magnets, 3, compresses the spring, 4, into the hole of the coil windings, 2*a*, 2*b*, 2*c*, 2*d*, then, the whole structure of the circularly arranged magnets, springs, and metallic coil windings, all in all, experience contraction that places circumferential and radially directed centripetal force and pressure onto the flexible pipe, 1, as in FIG. 1. The squeezed pipe, 1, will transmit force and pressure onto the fluids, 0, contained within the segment of the pipe, 1, FIG. 1. This squeezing action on the fluids, 0, propels the fluids out of the pipe, 1, accomplishing the pumping action by this novel "Pipe Pump", system, FIG. 1. So, while the magnets, 3, and the metallic coil windings, 2*a*, 2*b*, 2*c*, 2*d*, are squeezing the pipe, 1, the electrodes, 5, 6, on the respective coil windings, 2*a*, 2*b*, 2*c*, 2*d*, have come off their electrical conducting contact points on the entities, 7 and 8, FIG. 1. Now, there will be no current inside the coil windings, 2*a*, 2*b*, 2*c*, 2*d*, and no magnetic fields produced inside the said coil windings to attract the magnets, 3, thence, the non-conducting compression spring which was in the compressed state before, pushes back the magnets, 3, against the base plate, 2*p*, of the coil windings, 2*a*, 2*b*, 2*c*, 2*d*, making the magnets, 3, and the metallic coil windings, 2*a*, 2*b*, 2*c*, 2*d*, come away and apart from each other until they completely stretch the springs, 4, back to its normal steady state length, FIG. 1. Subsequently, the pipe, 1, goes back to its expanded, relaxed, original state, allowing the inflow of fluids into this newly created low pressure space of the pipe, 1, FIG. 1. Immediately, the metallic electrodes, 6 and 5, come in contact with the stationary and circularly arranged metallic contact points, 7, 8, once again supplying electricity to the coil windings, 2*a*, 2*b*, 2*c*, 2*d*, FIG. 1. Subsequently, the magnets, 3, and coil windings, 2*a*, 2*b*, 2*c*, 2*d*, and the spring, 4, will all contract again, forcing the pipe, 1, and the contained fluids, 0, to be squeezed out, pumping the fluids away from the pipe, once more. Hence the cyclical process of the pipe, 1, expanding and contracting will cause pumping of fluids out of the pipe, so long as power is available to the coil windings, 2*a*, 2*b*, 2*c*, and 2*d*, through the electrodes, 5 and 6, FIG. 1.

Note that the pipe pump can be powered by a battery, or electricity coming from an AC current source, FIG. 1. If an AC source is powering the pipe pump then the contraction frequency of the coil windings and the magnets and the pipe will depend on the frequency of the AC current that is supplied. A DC current source like a battery can be attached to an Inverter, 10, (DC to AC current converting device), which in turn is attached to the hollow coil windings, 2*a*, 2*b*, 2*c*, 2*d*, to allow the pipe pump, to pump fluids at a given frequency, as well, FIG. 1. If an Inverter, or an AC current source is used within the switch, 10, then conceivably the paired metallic electrical contacts, 5 and 7, 6, and 8, can be permanently connected continuous metallic entities, without any gaps between them, (entities, 5 and 7, 6 and 8), so as to allow the pipe pump system to be actuated. Now, the source of the electrical power can also be from a set of solar panel (photovoltaic cells) that can be attached to the outside surface of the pipe pump system. Interestingly, note, that the reversal of current in the terminal, (negative and positive to positive and negative, and vice versa), side of the metallic coil winding, (or, the hollow electromagnet), 2, by use of a toggle switch, can cause the generation of repulsive electromagnetic forces between the magnets, 3, and the metallic coil entities, 2, thus, yielding into the expansion of the pipe pump system, FIG. 1, after a contraction has occurred, (making the need for the springs, 4, unnecessary, in the pipe pump system).

As mentioned before, attached to the outer rigid tube, 9, can be the power source like the battery, 11, and the entity, 10, which can be, a switch, or, an Inverter, or, a Rectifier, or, a microchip, or, a microprocessor, or, a mother board, etc., and, or, combination thereof, FIG. 1. The microprocessor, and, or, a mother board can be specially designed and programmed to function in modulating the frequency and amplitude of contraction of the pipe pump by modulating the current and the voltage being sent into the pipe pump system. The amplitude of contraction would have to coincide with the force of contraction of the pipe pump exerting on the fluids contained, therein. And that is depended on the amount and amplitude of electricity provided to the electromagnets or the metallic coil windings by the said electronics including the microprocessor and mother board combination apparatus. The frequency of the contraction of the pipe pump onto the fluids contained therein, will also depend on the frequency of electricity delivered to the pipe pump system, again, by the said pre-programmed electronics, microprocessor, and, or, the mother-board combination apparatus. And that these electromagnets, coil windings, springs, pipes, and, or, tubes, can be very large or small, down to the millimeter range, or, in the micron range, or even on the nanometer scale or can be nanotechnology type electromagnetic actuators, all of which can be configured around the pipe pump tube to make the pipe pump functional; and this applies to all the varied configurations of the pipe pump disclosures.

Figures 1, 2A:
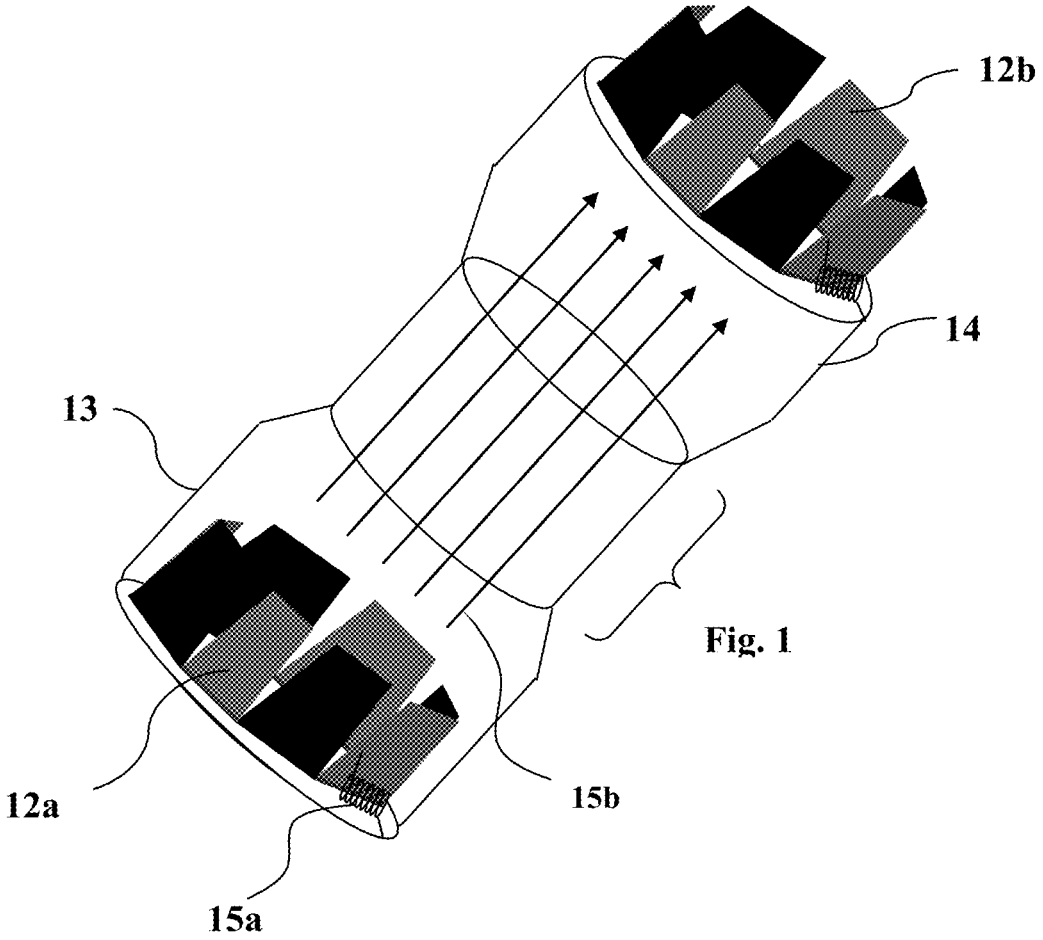
FIG. 2*a* Shows the pipe pump with a set of back end and front end valves for making forward flow of fluids possible.

In FIG. 2*a*, are additions to the pipe pump that make the whole device function even better. And these features are the two one way valves, 12*a* and 12*b*, situated in the back and front part of the pipe pump device of FIG. 1, as shown in FIG. 2*a*. Herein, a sturdy stationary cylindrical pipe, 13 and 14, are affixed to the back and front part of the pipe pump of FIG. 1, as shown in FIG. 2*a*. So, a one way valve, 12*a*, is affixed to the inner wall of the sturdy stationary pipe, 13, FIG. 2*a*. Similarly, the other one way valve, 12*b*, is affixed to the inner wall of the sturdy stationary pipe, 14, FIG. 2*a*. The valve leaflets, 12*a*, opens into the pipe pump, FIG. 1, when the pipe pump relaxes, and the same valve, 12*a*, closes when the said pipe pump, FIG. 1, contracts. Similarly, the valve leaflets, 12*b*, opens away from the pipe pump, FIG. 1, when the pipe pump contracts, and valve leaflets, 12*b*, closes when the pipe pump, FIG. 1, relaxes or expands. Note that a torsion spring, 15*a*, is affixed on the outer valve leaflet surface of, 12*a*, 12*b*, and the other leg of the torsion spring affixes to the wall of the sturdy tube, 13 and 14, FIG. 2*a*. Therefore in this novel pipe pump design, FIG. 2*a*, when the pipe pump of FIG. 1, is actuated then the squeezing of the fluids within pipe pump of FIG. 1, causes the fluids to force open the front valve leaflets, 12*b*, and allow the fluids to move away from the pipe pump, and at the same time the back valve leaflets, 12*a*, closes due to back pressure of fluids coming from the contracting pipe pump, FIG. 2*a*. Thence, the valve, 12*a*, closes, and valve, 12*b*, opens, during the contracting phase of the pipe pump, FIG. 1, and allows for the forward flow of fluids out of the pipe pump, FIG. 2*a*. Then during the relaxing and expansion phase of pipe pump, FIG. 1, the valve, 12*b*, closes, and valve, 12*a*, opens, thereby letting the next volume of fluids to enter into the pipe pump, FIG. 1, space, to be pumped out again, FIG. 2*a*. Thus the cycle of contracting and relaxing of the pipe pump, FIG. 1, in combination with valves, 12*a*, 12*b*, opening and closing, yields the essential pumping function for the pipe pump to be augmented, so long as power is supplied to the pipe pump system. Note that the torsion spring, 15*a*, keeps the valve leaflets bent toward the center of the pipe pump and thus helps with the forward movement of the fluids within the pipe pump system. So, when the pipe pump contracts then the forward valve, 12*b*, opens and simultaneously the backward valve, 12*a*, closes, and when the pipe pump relaxes the forward valve, 12*b*, closes, and the backward valve, 12*a*, opens; and thus the valves open and closes in a cyclic manner propelling the pipe pump fluids in a forward direction. Now, these back and front valves can also be electronically and electrically controlled such that they open and shut through electronic and electric means during the contraction and relaxation phase of the pipe pump. And these valves don't necessarily have to be leaflet valves they can any type of valve (like solenoid valves, etc) that is available.

Figure 2B:
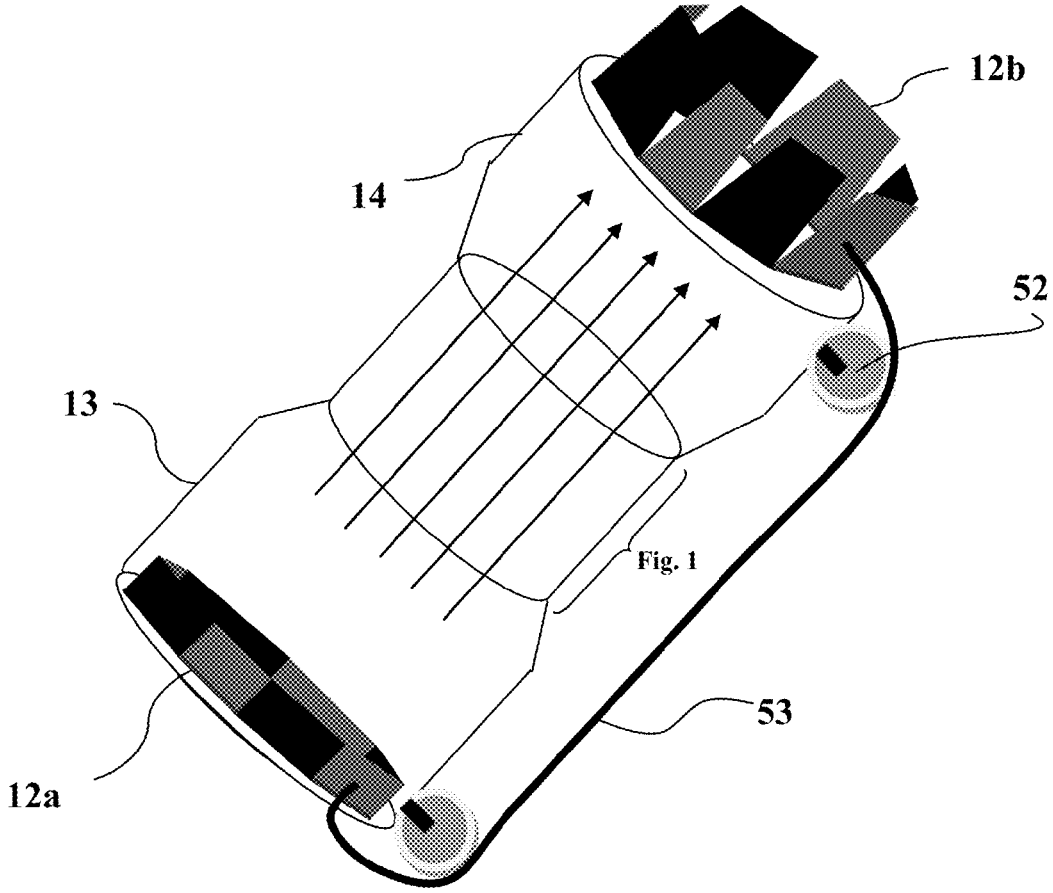
FIG. 2*b* Shows a rigid rod or a rigid strong string like entity that is affixed to the forward and backward valve leaflets by passing through a set of pulleys.

On the other hand, FIG. 2*b*, illustrates another mechanism operating on the front and back valves during the pumping phase of the pipe pump. A special rigid string or rod like entity, 53, are affixed to the front multi-leaflet mechanical valve, 12*b*, then, the rigid string rod like entity, 53, goes over two set of pulley, 52, and affixes to the back end of the multi-leaflet mechanical valve, 12*a*, FIG. 2*b*. Although one rigid string, 53, is shown, multiple such rigid string like entities can be attached between the valve leaflets, 12*a* and 12*b*. Note that the actuation part of the pipe pump, FIG. 1, is situated in between the rigid valve holding tubes or pipes, 13 and 14, FIG. 2*b*. When the pipe pump actuator, FIG. 1, is made operational, by the supply of electrical current, then, during the contraction phase of the pipe pump, FIG. 1, the forward, or, front valve, 12*b*, opens, while, the back valve, 12*a*, closes, due to the increased tension on the stretched rigid string, 53, entity, as shown in FIG. 2*b*. Thus the forward flow of fluids from the pipe pump occurs as the back valve, 12*a*, closes and the front valve, 12*b*, opens, FIG. 2*b*. When the pipe pump relaxes and goes back to its original expanded position, then, fluids behind the back valve, 12*a*, opens the said valve, 12*a*, to allow fluids to flow into the pipe pump due to decreased pressure inside the relaxing pipe pump system, FIG. 2*b*. At this time, the opening of the back valve leaflets, 12*a*, causes the tensile force through the rigid string, 53, to be experienced by the front valve leaflet, 12*b*, which is forced to shut and be closed, as in FIG. 2*b*. Thus during each cycle of relaxation and contraction of the pipe pump, FIG. 1, the forward and backward valves, 12*a*, 12*b*, closes and opens, in an alternative manner, so as to augment the pipe pumps propulsion of fluids forward, and at the same time prevents the backward flow of the same pumped out fluids, as in FIG. 2*b*.

Figure 3:
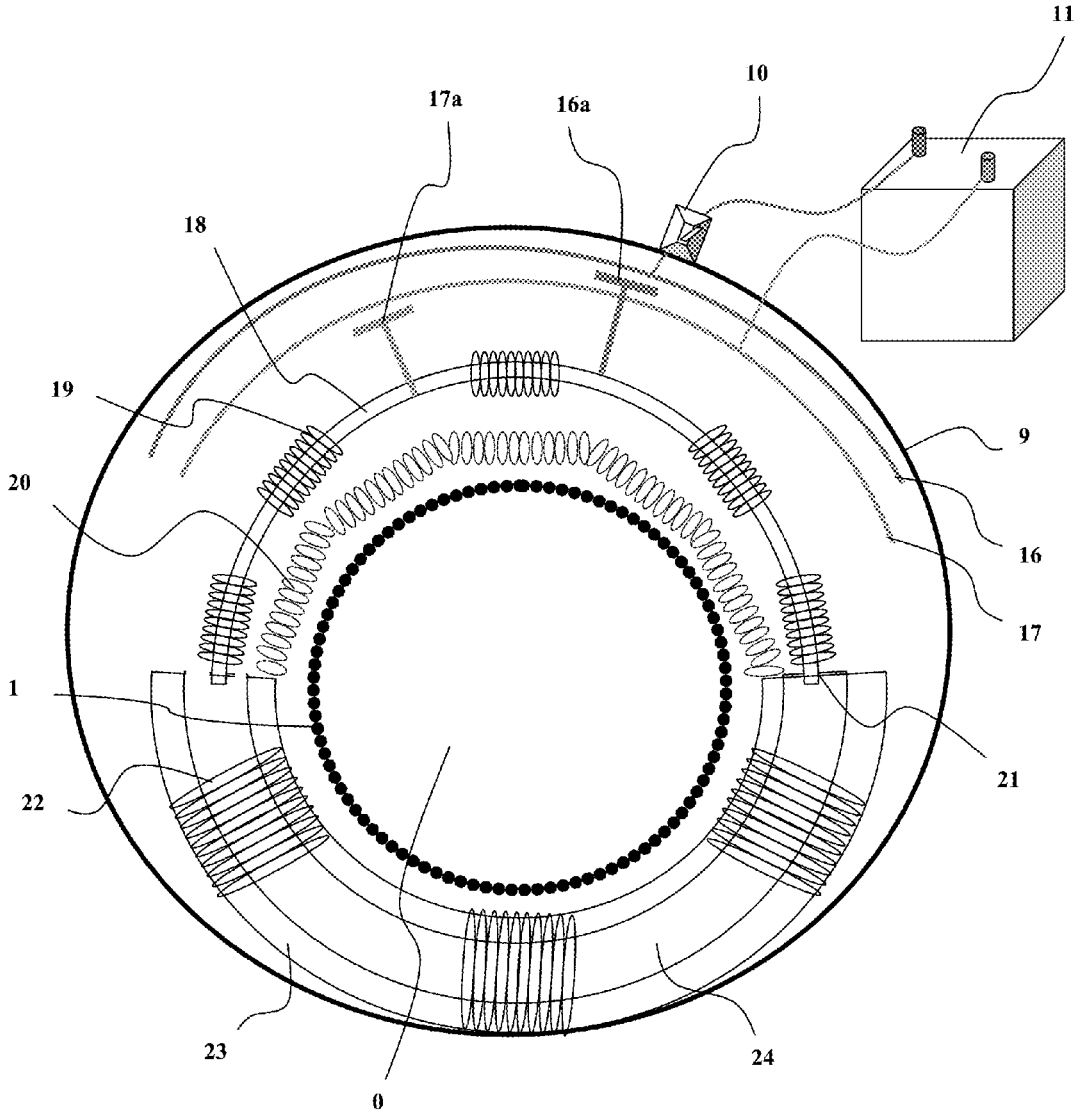
FIG. 3 Shows a different electromagnet arrangement for the pipe pump, as compared to the one in FIG. 1, wherein, a circumferentially arranged spring and a circumferentially arranged electromagnet coil windings articulate with a circumferentially arranged hollow permanent magnet, (or, electromagnet), and that these said entities go in and out of each other, when actuated.

In FIG. 3, another configuration of the pipe pump system is shown, wherein, the electromagnets are arranged somewhat differently around the flexible pipe, 1. Accordingly, the electromagnet coil windings, 19, are affixed onto a semi circular shaft, 18, and all of which surround the flexible pipe, 1, FIG. 3. One end of the semicircular shaft, 18, affixes permanently to a semi circular cylindrical shaped hollow permanent magnet, or, a hollow electromagnet with semi circular cylindrical shape, 23, FIG. 3. On the other end of the hollow semicircular permanent magnet, (or, the electromagnet coil windings), 23, entity, the said semicircular shaft, 18, (and its studded electromagnet coil windings, 19), articulates; and all three entities, 18, 19, and, 23, freely move and slide in and out of each other, as in FIG. 3. Obviously the electromagnet coil windings, 19, and its attached shaft, 18, have to be of smaller diameter size compared to diameter length of the hole inside the magnet, (or, the electromagnet), 23, entity, FIG. 23. The hollow electromagnet, 23, entity, can also be covered with an outside metallic coil windings, 22, that can boost the electromagnetic force generated within the electromagnet, 23, FIG.

3. The flexible pipe pump tube, 1, which contains the fluid, 0, is surrounded, first, by the contours of the hollow hard electromagnet or magnet entity, 23, and, second, by this spring (compression) like entity, 20, which is affixed to either side of the hard and hollow electromagnet or magnet entity, 23, FIG. 3. Then there are the metallic contact point like structures, 17*a*, and, 16*a*, which is affixed to the semicircular flexible shaft, 18, FIG. 3. The semi circular flexible shaft, 18, has electrical wiring built into its intrinsic structure so as to conduct any electricity from the metallic contact points, 17*a*, 16*a*, into the electromagnetic coil windings, 19, FIG. 3. Normally, the metallic contact points, 17*a*, 16*a*, are always in contact with the stationary semi circular metallic contact points, 17, 16, respectively, mostly due to the spring, 20, that pushes the semicircular shaft, 18, and the electromagnetic coils, 19, in an outward and expanded direction, as in FIG. 3. Now, the whole pipe pump configuration is encased within the rigid and hard cylindrical encasing, 9, FIG. 3. Outside of the encasing, 9, is affixed a switch, 10, which is electrically connected to a battery, 11, on one side and then to the semicircular metallic contact point entities, 16, (or, 17), on the other side, FIG. 3.

In essence when the switch, 10, is turned "on", then, electricity flows from the DC battery source, 11, into the semi circular metallic contact points, 16, (and also through, 17, as the pipe pump is a closed circuit entity), FIG. 3. (Note that an Inverter can be part of the switch, 10, when a DC power source supplies the energy to the pipe pump system. Or, the power source to the pipe pump can be of an AC current type, as well.) So, the electricity from metallic contact points, 17, 16, travels into the metallic contact points, 17*a*, 16*a*, and then simultaneously goes into the electromagnet coil windings, 19, FIG. 3. The electromagnet coil windings, 19, are then attracted into the hole, of the semi circular permanent hollow magnet, 23, entity, as in FIG. 3. At the same time electricity can be supplied by a set of wires (not shown) into the metallic coil windings, 22, to further augment the electromagnetic interaction between the electromagnet coil windings, 19, and the hollow electromagnet coil windings, 23, FIG. 3. Note that the direction of current flow into the electromagnet coil windings, 19, and the coil windings, 22, are so arranged to allow for attractive magnetic forces to be created between the electromagnet coil windings, 19, and the hole of the electromagnet coil windings, 23, FIG. 3. (Alternatively by using an automatic electronic toggle switch placed inside the switch, 10, a cyclical reversal of the negative and positive, terminal, of the currents going into the electromagnet coil winding, 19, and, 22, can occur, such that a attractive and repulsive electromagnetic or magnetic forces are generated between the electromagnet coil windings, 19, and electromagnet coil windings, 23, causing the contraction and expansion of the said pipe pump actuating entities, as in FIG. 3. Thus, the expansion and contraction between these said entities will yield the pumping function for the fluids as attributed to this design of the pipe pump system.) When the electromagnet coil winding, 19, and its shaft, 18, are pulled into the hole of the electromagnet, 23, the metallic contact points, 17*a*, 16*a*, are no longer in contact with their counterpart metallic contact points, 17, 16, whence, the spring, 20, the flexible rubber tube, 1, and the fluids, 0, are all compressed, causing the fluids to be pushed out of the pipe pump, FIG. 3. Subsequently, the electromagnet coil windings, 19, 22, will no longer have electricity in them, so, they, (18, 19, 22, 23), will begin to recoil back, as the attractive electromagnetic forces between the said hollow magnet, 23, and the electromagnet coils, 19, are attenuated away; causing, the spring, 20, to take over and provide for a recoil force pushing away the electromagnets, 19, and the shaft, 18, back to their original expanded positions, FIG. 3. When the electromagnet coils, 19, and the shaft, 18, come back to their original position then the metallic contact points, 17*a*, and 17, and 16*a*, and 16, touch each other again, allowing, the electrical current to flow again into the said electromagnet coil windings, 19, (or, 22), causing another contraction of the electromagnets, 19, and, the shaft, 18, into the hole of the magnet, 23, (or, "electrically powered" electromagnet coil windings), FIG. 3. So, the squeezing and compressing of the spring, 20, the rubber tube, 1, and the fluid, 0, inside the pipe pump apparatus, occurs again. This cyclic contraction and relaxation of the aforementioned apparatus again and again, will manifest into the pumping function for the pipe pump system, as in the design of FIG. 3.

Figure 4:
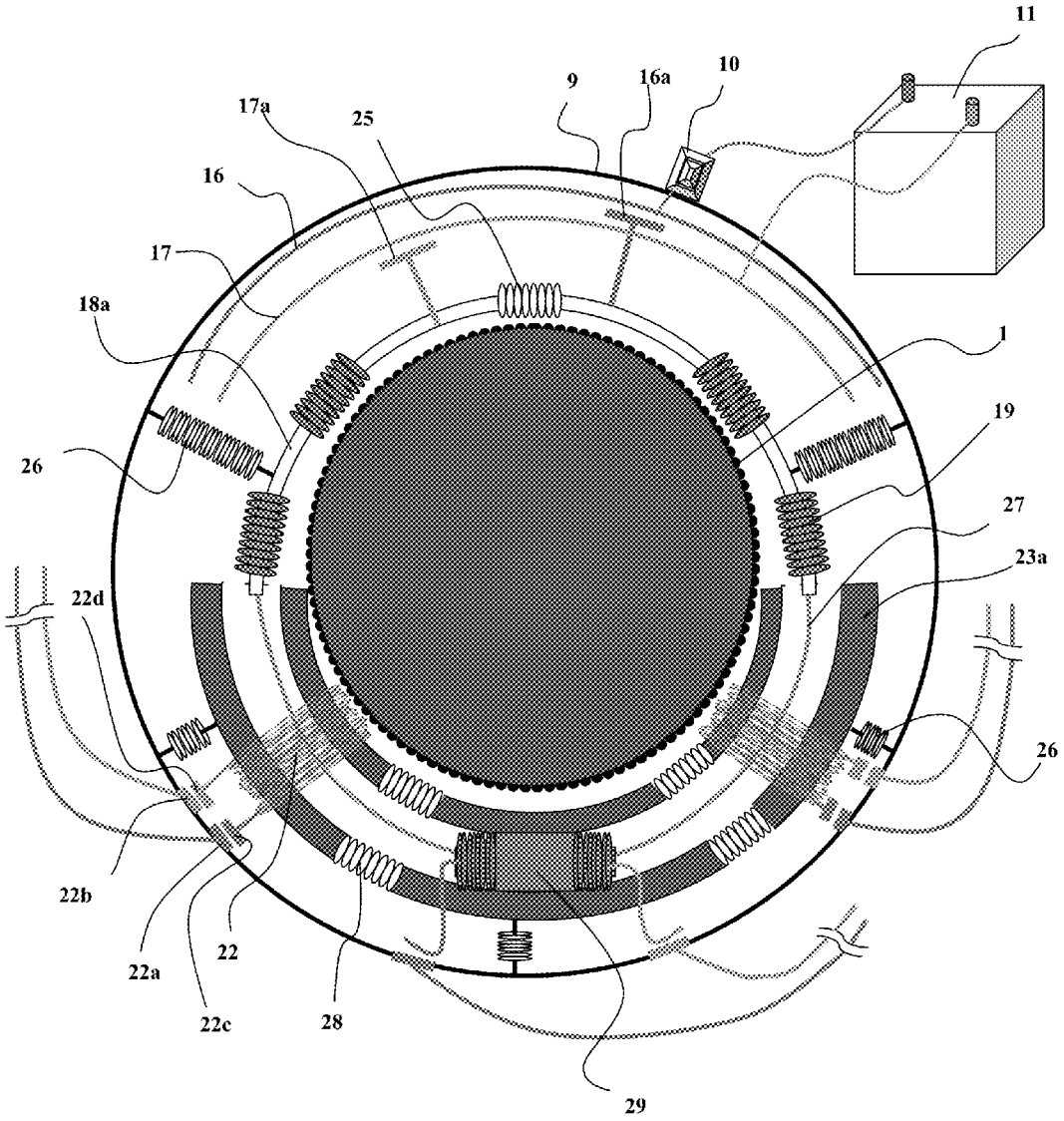
FIG. 4 Shows a pipe pump that has electromagnet coil windings, (or, electromagnets, or, magnets), being pulled by a set of radially arranged spring attachments within the pipe pump apparatus. (Also shown are the hollow permanent magnets surrounded by the metallic wire coil windings.) Note that these electromagnet coil winding, and, or, the magnet, can be broken into multiple smaller pieces, and be re-joined to each other with intervening spring like entities that allow substantial flexibility and bending movements of the conjoined set of electromagnetic coil windings, and, or, the electromagnets, and, or, the magnets, to occur.

Now, FIG. 4, represents another version of FIG. 3, pipe pump apparatus. Herein, the electromagnet coil windings, 19, are situated on a non-conducting semicircular shaft, 18*a*, which is made highly flexible by an intermittent attachment of springs (compression type), 25, in between two (or more), separated and fragmented semi circular shaft, FIG. 4. The jointed flexible semicircular shaft, 18*a*, entity is affixed to a set of radially placed compression spring, 26, which in turn are affixed to the wall of the rigid encasing, 9, FIG. 4. On either end of the split and fragmented semicircular shaft, 18*a*, is a highly strong (non-conducting) string, 27, which in turn circumscribes the inner hole of the magnet (or, "electrically powered" electromagnet coil windings), 23*a*, thereby, restricting the movement of the electromagnetic coil windings, 19, and the shaft, 18*a*, to occur only within the pre-circumscribed semi circular hole of the magnet (or, electrically powered electromagnet coil windings), 23*a*, FIG. 4. Note that the magnets, 23*a*, can also be modified even further, in that it can be fragmented and disjointed into smaller pieces and then joined together into a singular unit by intervening set of springs (compression type), 28, between them, FIG. 4. Then, the magnets, 23*a*, are anchored to the wall of the rigid encasing entity, 9, by the spring (compression type), 26, FIG. 4. Hence, during non motional, and non actuation phase of the entities, the electromagnet coil winding, 19, the jointed semicircular shaft, 18*a*, and the fragmented magnets, 23*a*, assembly, all, are fixed in a stationary position with respect to the rigid encasing, 9, and the flexible rubber tube, 1, FIG. 4. Note that another electromagnetic coil winding, 29, can be placed inside the hole of the entity, 23*a*, FIG. 4. The hollow electromagnets, 23*a*, can also be surrounded by the metallic wire coil windings, 22, FIG. 4, as has been mentioned before. And each of the electromagnet coil windings, 19, 29, 22, can have metallic contact points, 17*a*, 16*a*, and, 22*d*, 22*c*, which come into contact with electricity supplying stationary contact points, 17, 16, and 22*b*, 22*c*, respectively, FIG. 4. The switch (that can include an Inverter, Rectifier, microprocessor, motherboard, inductor, capacitor, or, resistor), 10, the battery, 11, the flexible rubber tube, 1, and the fluid, 0, are also shown in this design of the pipe pump system, FIG. 4.

When the switch, 10, is turned "on", the current from the battery, 11, flows into the reciprocal stationary contact points, 17, 16, 22*a*, 22*b*, and since the other metallic contact points, 17*a*, 16*a*, 22*c*, 22*d*, are in touch with aforementioned stationary contact points, the electricity then flows into the electromagnet coil windings, 19, 22, 29, FIG. 4. The direction of the current in the electromagnet coil windings, 19, 22, 29, are so configured that a resultant attractive magnetic fields are created between the electromagnet coils, 19, and the electromagnets (or, magnets), 23*a*, and, or, between the electromagnet coil windings, 19 and 29, of FIG. 4. The presence of the attractive magnetic forces will bring the electromagnet coil windings, 19, and the affixed shaft, 18*a*, to come inside the hole of the electromagnet coil windings, 23*a*, and, or, to move toward the attractive magnetic forces generated by the curved electromagnet coil windings, 29, as in FIG. 4; and at the same time overcome the outward centrifugal "pulling" force exerted by the spring, 26 and 25. The contracture of the electromagnet coil winding, 19, and the semi circular shaft, 18*a*, into the hole of the electromagnet (or, magnets), 23*a*, will yield a contraction and squeezing force that is transmitted into the flexible rubber tube, 1, and the fluid, 0, contained therein, henceforth, propelling the fluid, 0, out of the tube, 1, FIG. 4. Note that the string, 27, always guides the electromagnet coil windings, 19, and the semicircular shaft, 18*a*, into the hole of the electromagnet coil windings, (or, the magnet), 23*a*, with fidelity, and does not allow the disassembly of the entire pipe pump apparatus, FIG. 4. With each contraction, the contact points, 17*a*, 16*a*, with, 17, 16, and, 22*a*, 22*b*, with 22*c*, 22*d*, comes apart from each other, and electricity does not flow into the electromagnet coil windings, 19, 22, 29, and the attractive magnetic fields disappears immediately, causing the retraction and pulling out of the electromagnet coil windings, 19, and its affixed semicircular fragmented shaft, 18*a*, out of the hole of the electromagnet coil windings, 23*a*, due to the centrifugal force exerted by the affixed set of springs, 26, 25, FIG. 4. The outward pull of the electromagnetic coil windings, 19, and the semi circular shaft, 18*a*, with respect to the hole of the electromagnet coil windings, (or magnet), 23*a*, will cause the relaxation of the inner flexible and resilient rubber tube, 1, thus, causing the vacated and propelled fluid out of the tube, 1, to be occupied again with another incoming volume of fluid, 0, due to low pressure conditions in the flexible pipe, 1, FIG. 4. Then again, the metallic contacting points, 17*a*, 16*a*, with, 17, 16, and, 22*a*, 22*b*, with 22*c*, 22*d*, touch each other once more, causing the contracture of the pipe pump system to happen again, FIG. 4. Now, the outward retraction of the electromagnet coil windings, 19, and the semicircular jointed shaft, 18*a*, with respect to hole of the electromagnet coil windings, 23*a*, can be accomplished by another mechanism, wherein, the springs, 26, may not be required, but the repulsive electromagnetic forces can be generated between the electromagnet coil windings, 19, and, 23*a*, simply by reversing the current terminals going into the electromagnet coil windings, 19, 22, (and 29), FIG. 4. In this instance the contact points 17, 16, 22*a*, 22*b*, 17*a*, 16*a*, 22*c*, 22*d*, can be fused permanently and a "current terminal switcher" device, or, an "electronic toggle switch" device, 10, can supply power to the electromagnets, 19, 22, 29, such that attractive and repulsive electromagnetic forces manifests between the electromagnet coil windings, 19, and, 23*a*, or between, 19, and, 29, FIG. 4. Thus, the cycle of compression and relaxation of the rubber pipe, 1, occurs, at a given frequency and/or periodicity, that culminates into the pumping out of the contained fluids, 0, within the pipe pump boundaries, 1, at a given frequency and/or periodicity, so long as electricity is made available into this design of the pipe pump system, FIG. 4.

Figure 5:
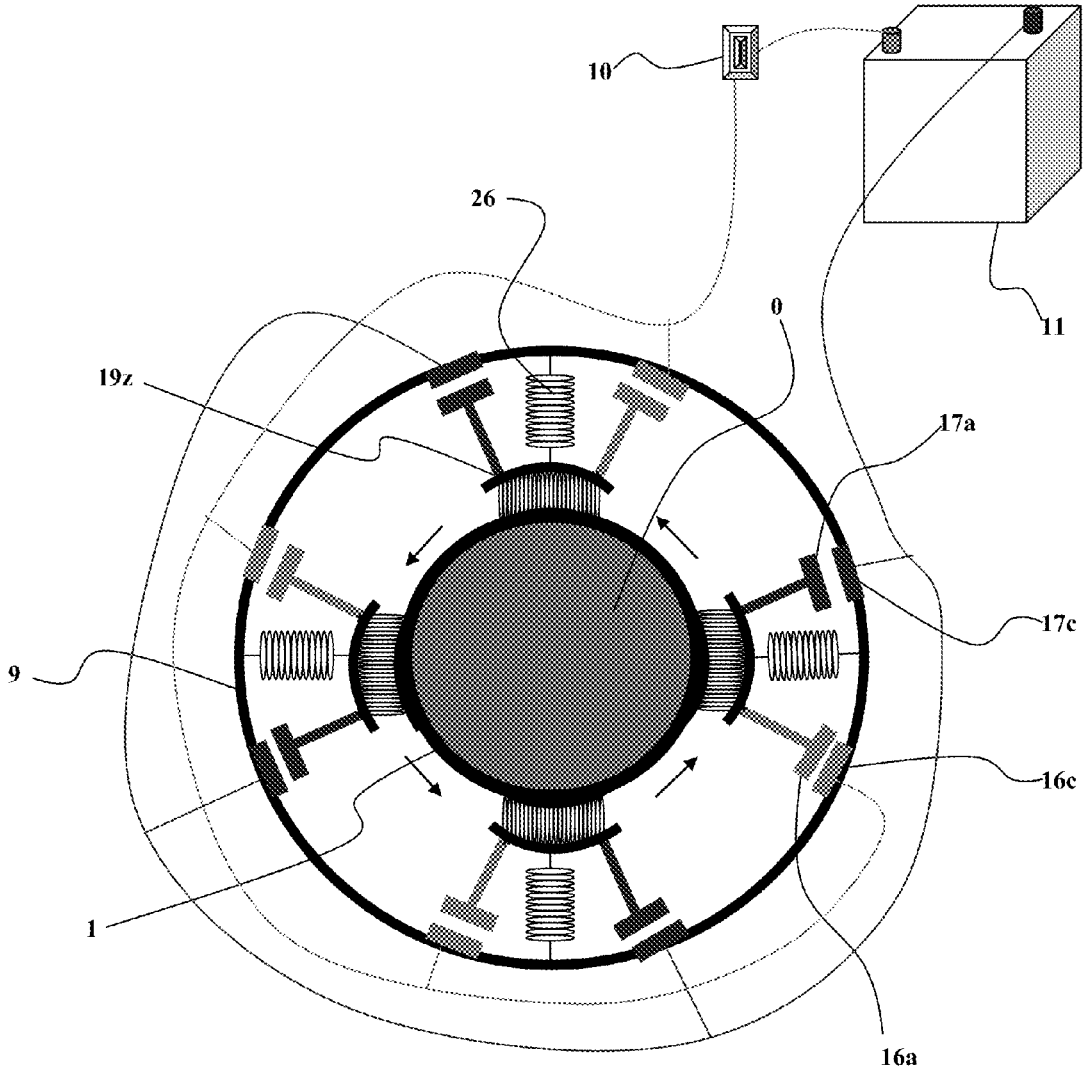
FIG. 5 Shows a simpler version of the pipe pump configuration as compared to the one in FIG. 4; wherein, the electromagnets, or, the electromagnet coil windings, are permanently affixed to the outer surface of the flexible tube of the pipe pump system.

A simpler version of the design configuration of FIG. 4, can be represented in FIG. 5, herein, the electromagnet coil windings, 19*z*, are embedded and affixed on top of the flexible rubber tube pipe, 1, FIG. 5. And these electromagnet coil windings, 19*z*, have an associated curvature to its structural construction such that the magnetic fields they generate (as indicated by the arrows) also has an associated curvature, like a toroid with its curved magnetic fields, FIG. 5. Note that in between the curved electromagnet coils, 19*z*, there are air filled empty spaces, where, the said curved magnetic fields manifests, when electricity is given into the electromagnet coil windings, 19*z*, FIG. 5. The electromagnet coil windings, 19*z*, have two set of positive and negative terminals with an accompanying metallic contact points, 17*a* and 16*a*, FIG. 5. Normally, the metallic contact points, 16*a* and 17*a*, are always in contact with their counterpart stationary metallic contact points, 17*c* and 16*c*, FIG. 5. And the (non-conducting) compression spring, 26, affixes the electromagnetic coils, 19*z*, to the inner surface of the strong encasing, 9, FIG. 5.

When the switch, 10, is turned "on", then, current goes through all the metallic contact points, 17*c*, 17*a*, 16*c*, 16*a*, and ends up powering the electromagnet coil windings, 19*z*, of FIG. 5. The electromagnetic interaction or rather the attractive magnetic fields created between each of the electromagnet coils, 19*z*, pulls them toward each other, thus squeezing the flexible tube, 1, and pressurizing the fluids contained within the flexible tube, 1, to be expelled and pumped out, FIG. 5. This constitutes the contraction phase of the pipe pump, FIG. 5. (Note, quite poignantly, that the electromagnet coil windings, 19*z*, can be designed to radially face each other, with the flexible tube in between, such that the magnetic fields that are generated will create attractive forces between the oppositely placed electromagnet coil windings, 19*z*, causing the squeezing of the tube, 1, and the fluids, 0, contained within, and, or, the said oppositely placed electromagnets, 19*z*, can be made to magnetically repulse each other, to cause the relaxation and expansion of the flexible tube, 1, all, occurring in a cyclical manner, FIG. 5.) And when no electrical current is present within the electromagnet coils, 19*z*, the magnetic attraction between the adjacent electromagnet coil windings, 19*z*, will dissipate and the stretched out compression spring, 26, will pull on the electromagnet coil windings, 19*z*, toward the rigid strong stationary encasing, 9, thus, allowing the metallic contact points, 17*a*, 17*c*, and, 16*a*, 16*c*, to completely touch each other, again, FIG. 5. This constitutes the relaxation phase of the pipe pump system in FIG. 5. At this time, the pipe pump succumbs to its larger diameter configuration and expands to allow additional volume of fluid to enter into the flexible tube, 1, space, due to the creation of low pressure condition, thus, positioning this new volume of fluid to be pumped back out again, during the next and immediate contraction phase of the pipe pump, FIG. 5. And, as soon as the metallic contact points, 17*c*, 17*a*, and 16*c*, 16*a*, come in touch with each other electricity begins to flow into the electromagnet coil, 19*z*, thence, creating the squeezing and contracture of the flexible and resilient tube, 1, and pressurizing the contained fluids, 0, therein, to be propelled out of the flexible tube, 1, once more, FIG. 5. So, between the relaxation phase and contraction phase of this pipe pump system any given fluids can be pumped out.

Figure 6:
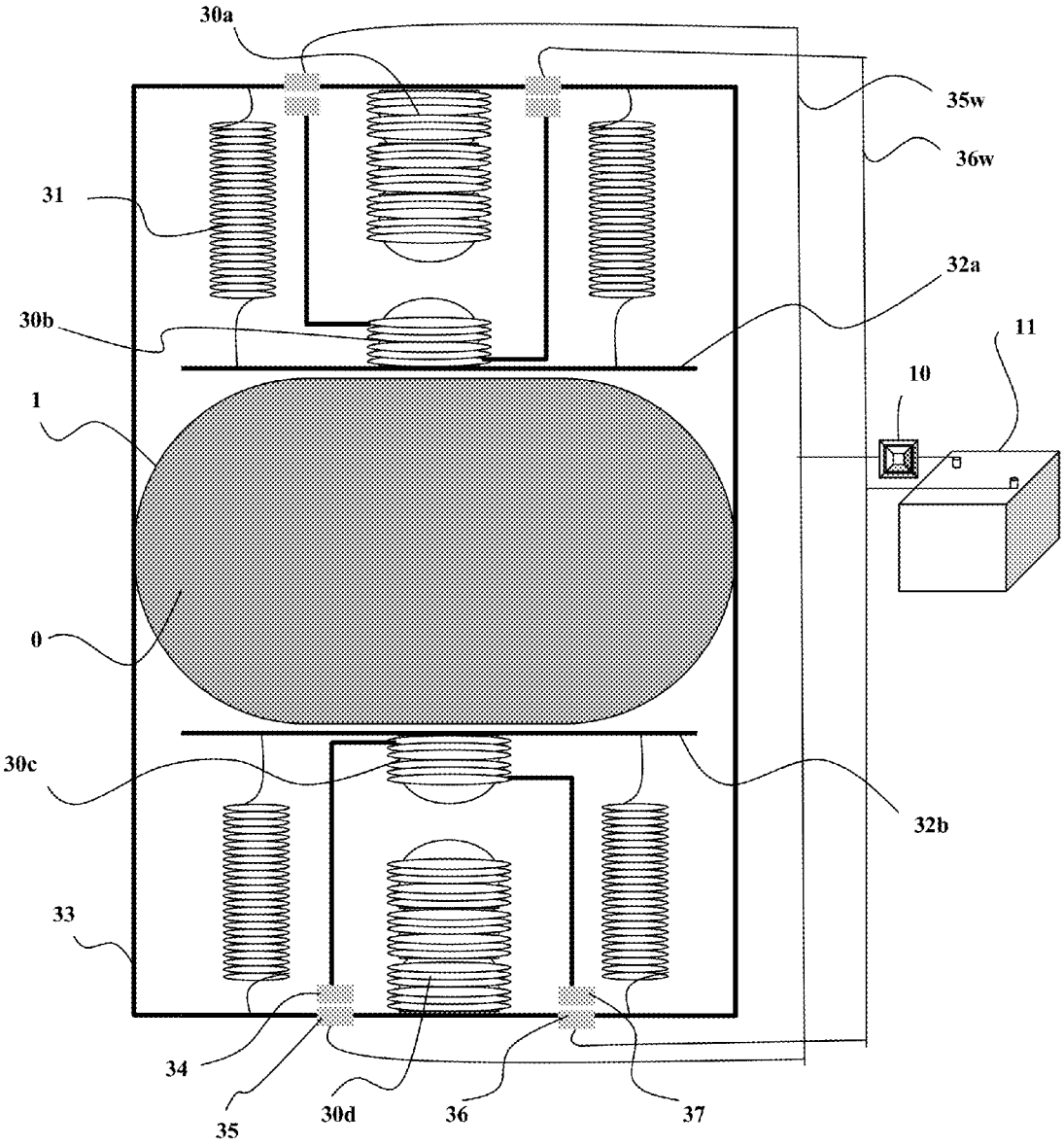
FIG. 6 Shows another arrangement of the electromagnets in the pipe pump device, wherein, two pairs of the electromagnet coil windings, are circumferentially arranged and surround the pipe pump flexible tube system.

Another way the electromagnets can be arranged around the flexible pipe pump rubber tube, 1, is as shown in FIG. 6. Herein, oppositely placed electromagnet coil winding pairs, 30*a*, 30*b*, and, 30*c*, 30*d*, surround the pipe pump flexible rubber tube, 1, containing the fluid, 0, FIG. 6. The electromagnet coil windings, 30*b*, 30*c*, are affixed to the plates, 32*a*, 32*b*, respectively, which in turn may sit around the tube, 1, unattached, or, can be permanently affixed to the tube, 1, FIG. 6. On the other side of the plates, 32*a*, 32*b*, are an affixed pair of compression spring, 31, FIG. 6. The said spring, 31, are in turn affixed to the strong rigid stationary encasing, 33, FIG. 6. On both ends of the electromagnetic coil windings, 30*b*, 30*c*, are these metallic contact points, 34, 37, that come in contact with its counterpart stationary metallic contact points, 35, 36, FIG. 6. The stationary metallic contact points, 35, 36, are electrically connected to the power source like a battery, 11, with an intervening switch, 10, FIG. 6. The electromagnet coil windings, 30*d*, 30*a*, are electrically not connected to any entity but is permanently affixed to the non conducting encasing, 33, FIG. 6. Note that the flexible rubber tube, 1, is surrounded not only by a set of electromagnet coil winding pairs, 30*b*, 30*c*, and its affixed plates, 32*a*, 32*b*, but also by the rigid strong wall of the non conducting encasing, 33, FIG. 6.

So, the mechanism of action for the configured apparatus in FIG. 6, is as follows: when, the switch, 10, is turned "on", then, electricity begins to flow from the power source like the battery, 11, through the wires, 35*w*, 36*w*, into the stationary metallic contact points, 35, 36, FIG. 6. As the electricity flows from stationary contact points, 35, 36, into the "movable" metallic contact points, 34, 37, the electrical current ends up powering the electromagnet coil windings, 30*b*, 30*c*, (through the attached set of wires). At this time, the electromagnetic coil windings, 30*b*, 30*c*, will retract backwards with respect to the stationary electromagnet coil windings, 30*a*, 30*d*, by way of the Lenz's Law of Electromagnetic Induction, that occurs between the oppositely paired set of electromagnet coil windings as configured in FIG. 6. While the electromagnet coil windings, 30*b*, 30*c*, moves away, from the electromagnet coil winding, 30*a*, 30*d*, it will make its affixed plates, 32*b*, 32*a*, place pressure on the flexible tube, 1, FIG. 6. The flexible (rubber) tube, 1, will be compressed from above and below simultaneously by the actuated sets of electromagnet coil windings, 30*b*, 30*c*, FIG. 6, such that the pertinent compression of the fluid, 0, present within the tube, 1, materializes, FIG. 6. Thus the volume of fluid, 0, is vacated or pumped out of the segment of the flexible tube, 1, where it is surrounded by the paired set of electromagnet coil windings, 30*c*, 30*d*, 30*b*, 30*a*, FIG. 6. Note that while the electromagnet coil windings, 30*c*, 30*b*, cause the compression of the flexible tube, 1, the contact points, 34 with 35, and 37 with 36, will come apart from each other and electrical conductivity and connectivity is severed, making the electromagnetic interaction between the electromagnetic coil windings, 30*d*, 30*c*, and 30*a*, 30*b*, purged, thus, causing the spring (compression type), 31, to become passively operational, pulling on the electromagnet coil windings, 30*c*, 30*b*, to come back to its original position and into close spatial proximity to the electromagnet coil windings, 30*d*, 30*a*, once more, allowing the metallic contact points, 34, 35, and 37, 36, to reestablish physical and electrical connection between each other, FIG. 6. Again, when the metallic contact points, 34, 35, and 36, 37, temporarily touch each other, the, electricity begins to flow from the power source, 11, into the electromagnet coil windings, 30*c*, 30*b*, which will be actuated in a repulsive fashion causing the compression of the flexible tube, 1, and pumping out of fluids, 0, contained therein, FIG. 6. The back and forth movement of the electromagnet coil windings, 30*c*, 30*b*, will similarly create a cycle of compression and relaxation of the flexible tube, 1, thence, causing the pumping of incoming fluids, 0, out of the flexible tube, 1, segment, over and over again, FIG. 6.

Figure 7:
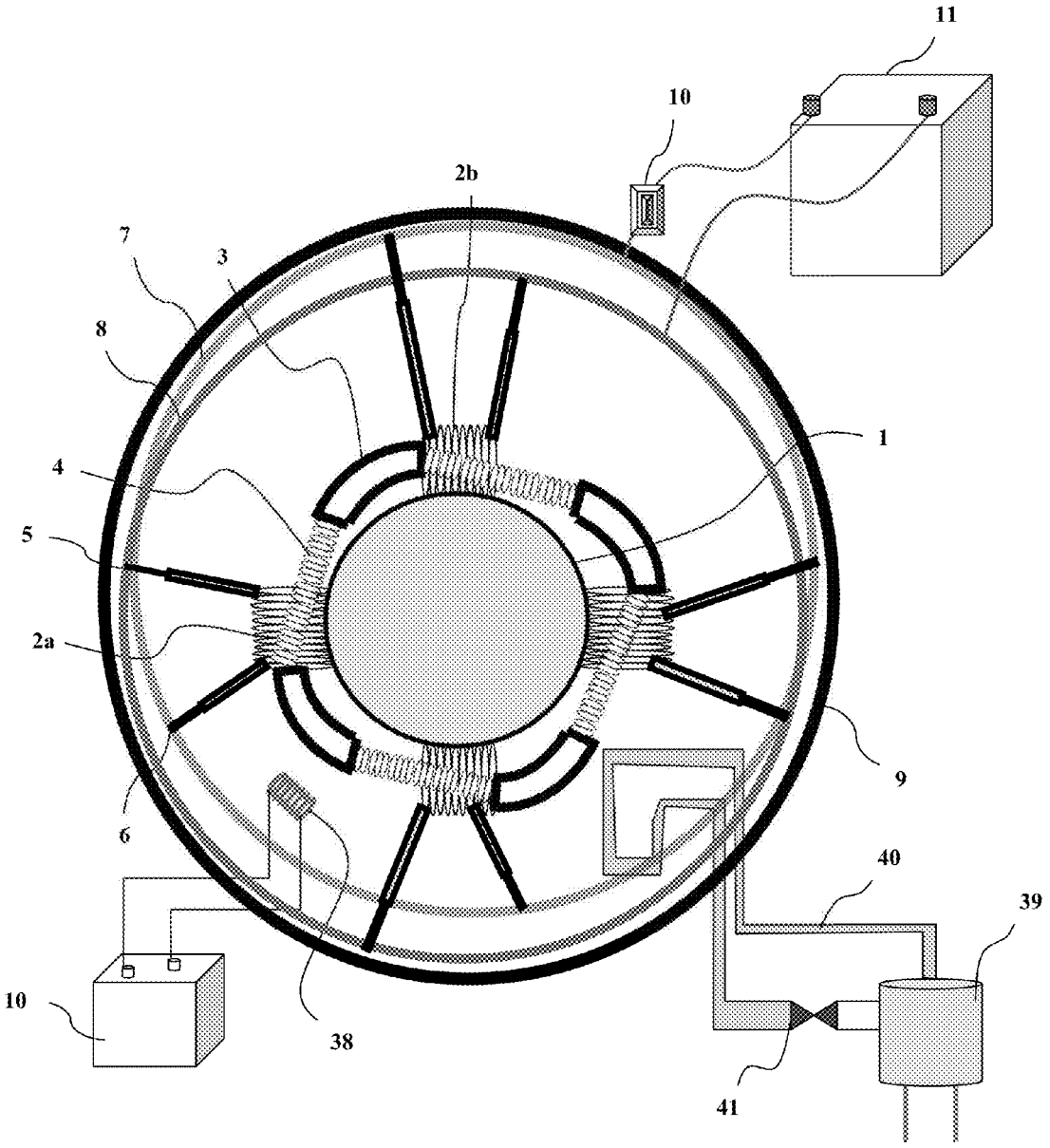
FIG. 7 Shows the pipe pump system containing a microprocessor, (with a combination of inductor, capacitor, resistor), and, or, mother board, and, or, heating system, and, or, a cooling system with an attached refrigeration system, or, an Inverter between the battery and the contact points of the pipe pump; all, configured to further augment the function of the pipe pump system. There can be sensors and detectors (with accompanying microprocessor units) also built within the walls of the pipe pump unit to monitor flow, pressure and temperature within the pipe pump system and then to adjust and control the pipe pump operations accordingly.

Now into FIG. 1, one can add a heating and cooling systems, as well as, electromagnetic detectors and sensors, (pressure sensors, flow sensors, temperature sensors), to augment the functioning of the pipe pump system, which are featured in FIG. 7. Electromagnetic radiation sources ranging from visible light to UV, or, radioactive electromagnetic waves like x-rays, gamma rays, can all be made part of the pipe pump system, as well. And these aforementioned entities can be situated outside, inside, or, even inside the flexible and resilient tube, 1, of the pipe pump system.

In FIG. 7, shown is a outside compressor, 39, connected to a system of cooling tubes, 40, (which are situated within the pipe pump system), and an expansion valve, 41, all of which, cools the pipe pump and fluids contained therein, to a any desired temperature. Similarly, heating coils, 38, or, any other heating source for that matter, powered by any power source including a battery, 11, can be placed anywhere inside the pipe pump, as in FIG. 7; and this will heat the pipe pump system and the fluids contained therein to any desired temperature. The entity, 7 and 8, can represent other objects, besides a circularly configured metallic wire. Likewise the entities, 7, 8, can represent are sensors, and, or, detectors, and, or, any number of electromagnetic emitting and detecting devices, FIG. 7. Thus while the fluids are being pumped out of the pipe pump, they can be cooled, or, heated, or, have different kinds of electromagnetic waves interact with the said fluids, 0. For instance UV light source being directed toward the pipe pump fluid will eliminate and kill germs inside the said fluid as it is being propelled out of the pipe pump system. Or, through a side tube, 48, as in FIG. 8, different chemicals can be added to the pipe pumped fluids, as well.

Figure 8:
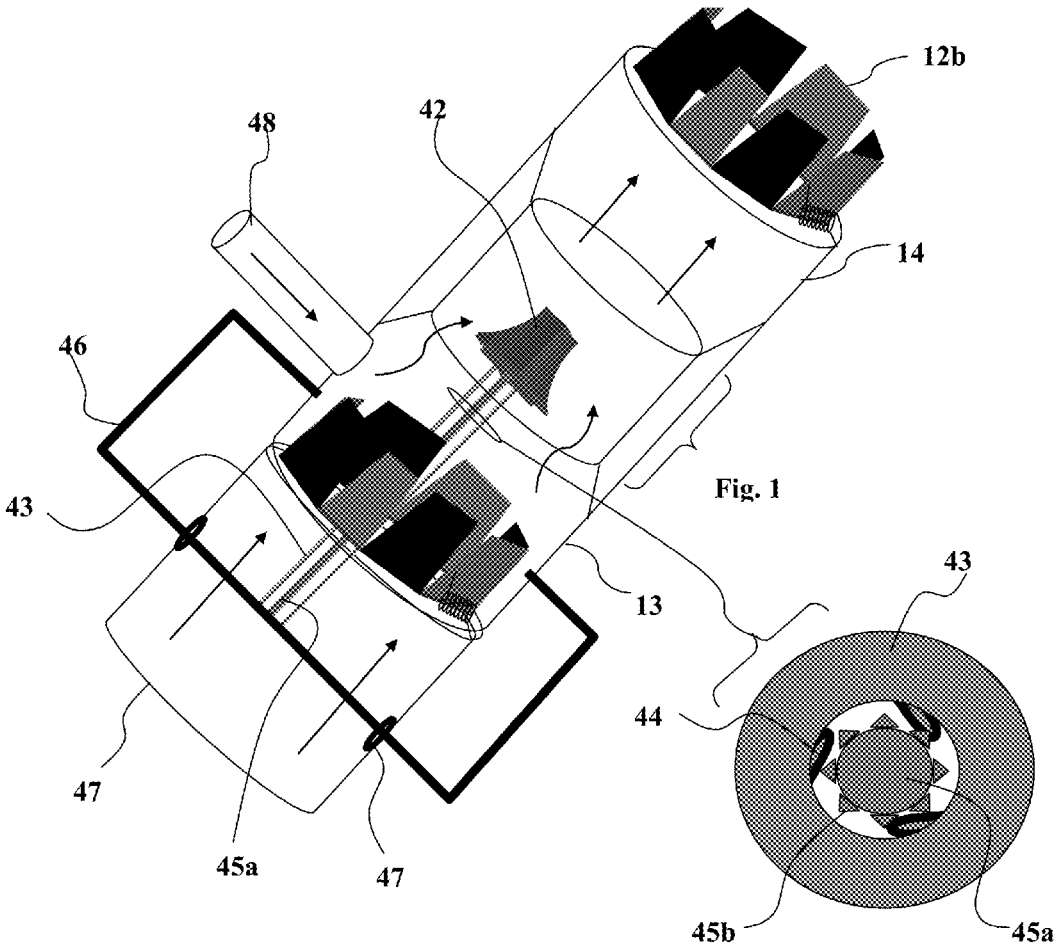
FIG. 8 Shows a small turbine, and, or, a fan blade, and, or, a piezoelectric crystal system in the shape of turbine or fan, placed at the center of the pipe pump apparatus, in order to augment the flow, pressure and volume of fluids going through the pipe pump system.

In FIG. 8, shown are supplementary entities that enhances the functioning of the pipe pump system. For instance a turbine, (shaped like a screw, and, or, any other shape turbine blades, or, fan blades), 42, can be placed in the middle of the flexible and resilient tube, 1, within the pipe pump system. This turbine or fan blade, 42, will attach to a shaft, 45*a*, that will allow the turbine or fan blade, 42, to have rotational freedom around its axis, FIG. 8. However, to ensure that the rotation of the turbine, 42, happens in only one direction, (clockwise or counter-clockwise), the shaft, 45*a*, can have a solid set of teeth like projections, 45*b*, jutting out to articulate with the another set of three solid blunted (and placed at some angle), inner teeth like projections, 44, jutting out of the walls of a stationary tube, 43, as in FIG. 8. Now, the shaft, 45*a*, is contained within the stationary encasing entity, 43, as in FIG. 8. The stationary tube, 43, is permanently anchored onto the rigid plate or rod like entity, 46, which in turn loops around to affix onto the outer stationary encasing, 13, of the pipe pump system, FIG. 8. Note that the shaft, 45*a*, articulates with a hole inside the solid anchoring entity, 46, such that the rotational motion of the shaft, 45*a*, is preserved, without causing the dislocation of the shaft, 45*a*, off the entity, 46, FIG. 8. The solid anchoring entity, 46, passes through a set of O-ring, or, gasket, 47, which functions so as to not allow the leakage of fluids out from the pipe pump system. Hence, when the pipe pump is operational and the pipe pump fluids are being squeezed and pressurized, then, the turbine blades, 42, will spin allowing for further forceful expulsion of fluids, 0, out of the pipe pump system, FIG. 8. And the rotational motion of the turbine blades, 42, will happen in only one direction (clockwise or counter-clockwise), in order that the fluids, 0, are moved or pumped out in the forward direction only, as shown by the arrow in FIG. 8. The solid teeth, 45*b*, on the shaft, 45*a*, which articulates with angularly placed blunt solid stationary teeth, 44, will not allow the backward rotational motion of the shaft, 45*a*, due to frictional forces created between the teeth, 45*b* and 44, FIG. 8. The teeth, 44 and 45*b*, are so placed to allow only one directional rotational motion, (clockwise or counter-clockwise), of the shaft, 45*a*, to be possible. Thus, when the pipe pump undergoes the relaxation and expansive phase of the "pumping cycle", then, the turbine, or, fan blades inside the flexible tube, 1, will not be able to rotate and will be stationary, FIG. 8. The shaft, 45*a*, can be also actuated or rotated by any number of other actuators, like a motor, or, a circular solenoid attachment, etc., to augment the functioning of the pipe pump system, FIG. 8. Note that fluids (or gases) can come in through another tube, 48, into the pipe pump allowing for the mixing of different fluids within the pipe pump flexible tube, 1, to occur, FIG. 8. More so, the turbine blade, 42, can be made from a piezoelectric crystal as well, which when actuated can cause the forward propulsion of fluids out of the pipe pump, FIG. 8. Of course, the piezoelectric crystal system will have to be attached to an amplifier and power source system and be inside a sealed encasing, or, inside a liquid free compartment, that does not damage the piezoelectric crystal apparatus, itself, FIG. 8.

Figure 9:
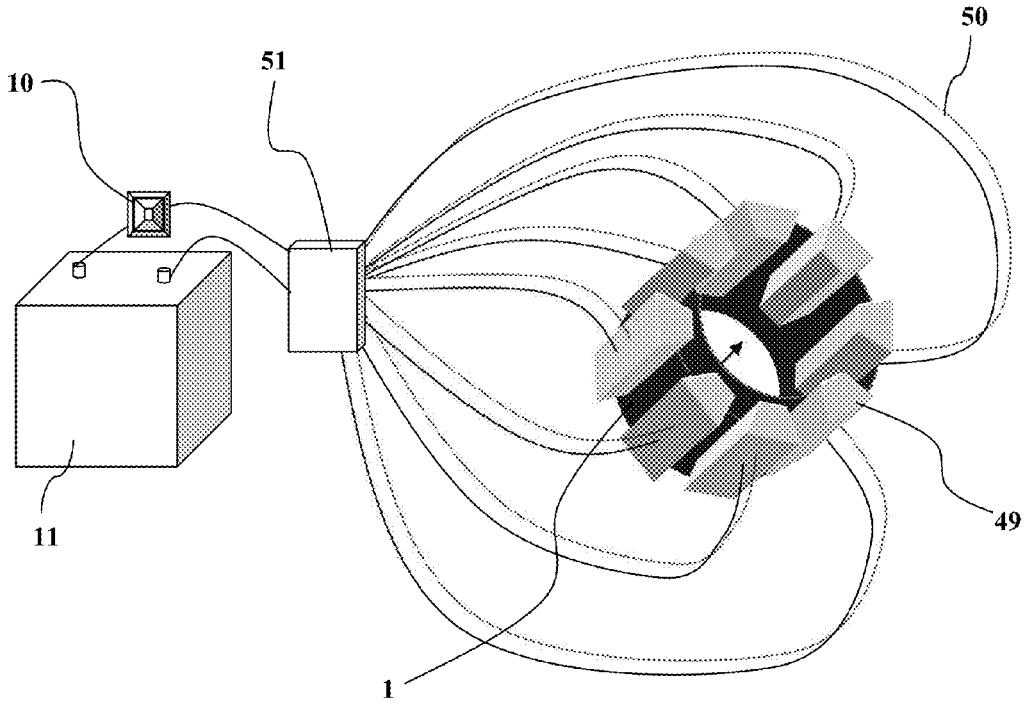
FIG. 9 Shows the piezoelectric crystal system affixed onto the walls of the pipe pump to function as another set of novel actuators for the pipe pump device.

Alternatively, another piezoelectric crystal system, 49, can be attached and affixed to the outer surface, or, the inner surface of pipe pump, as in FIG. 9. These piezoelectric crystal systems, 49, can be placed at any number of angular positions with respect to the surface of the flexible tube, 1, of the pipe pump system, as in FIG. 9. When actuated the piezoelectric crystal, 49, will vibrate any fluids contained within the pipe pump flexible tube, 1, and propel it forward and out of the pipe pump system, FIG. 9. Shown also within this diagram is the wiring, 50, the amplifier and regulator of current and voltage, 51, all of which are attached to the piezoelectric crystal system of the pipe pump, FIG. 9. Power source, 11, (battery), and switch, 10, are also shown in this design of the piezoelectric pipe pump system, FIG. 9. Thus, when the switch, 10, is turned "on", the piezoelectric crystal apparatus will vibrate within the flexible pipe tube, 1, or, outside of the flexible pipe tube, 1, imparting the vibration onto the fluid, 0, contained therein to be driven forward, out and away from this design of the pipe pump system, FIG. 9.

Now, any given motor pump system that has been operational for prolonged periods of time generates tremendous amount of thermal energy within the motor, which can cause the motor to burn out and be permanently damaged. Thus the motor of the conventional pump system will consume additional energy when measures like cooling system like fans are added to prevent motorized pump failure. In contrast, the thermal heat energy generated within the actuators or electromagnets of the pipe pump system can be cooled by the pipe pump fluids themselves. Quite simply, the pumped out fluids in the pipe pump system will carry away the heat and, or, the thermal energy with it as the fluid, 0, is being pumped out, thus, cooling the heated actuators of the pipe pump system. This allows the pipe pump actuators to work for longer periods of time without being damaged or destroyed by thermal energy as compared to motor pump systems.

The Electricity Generator Pipe System

Figure 10:
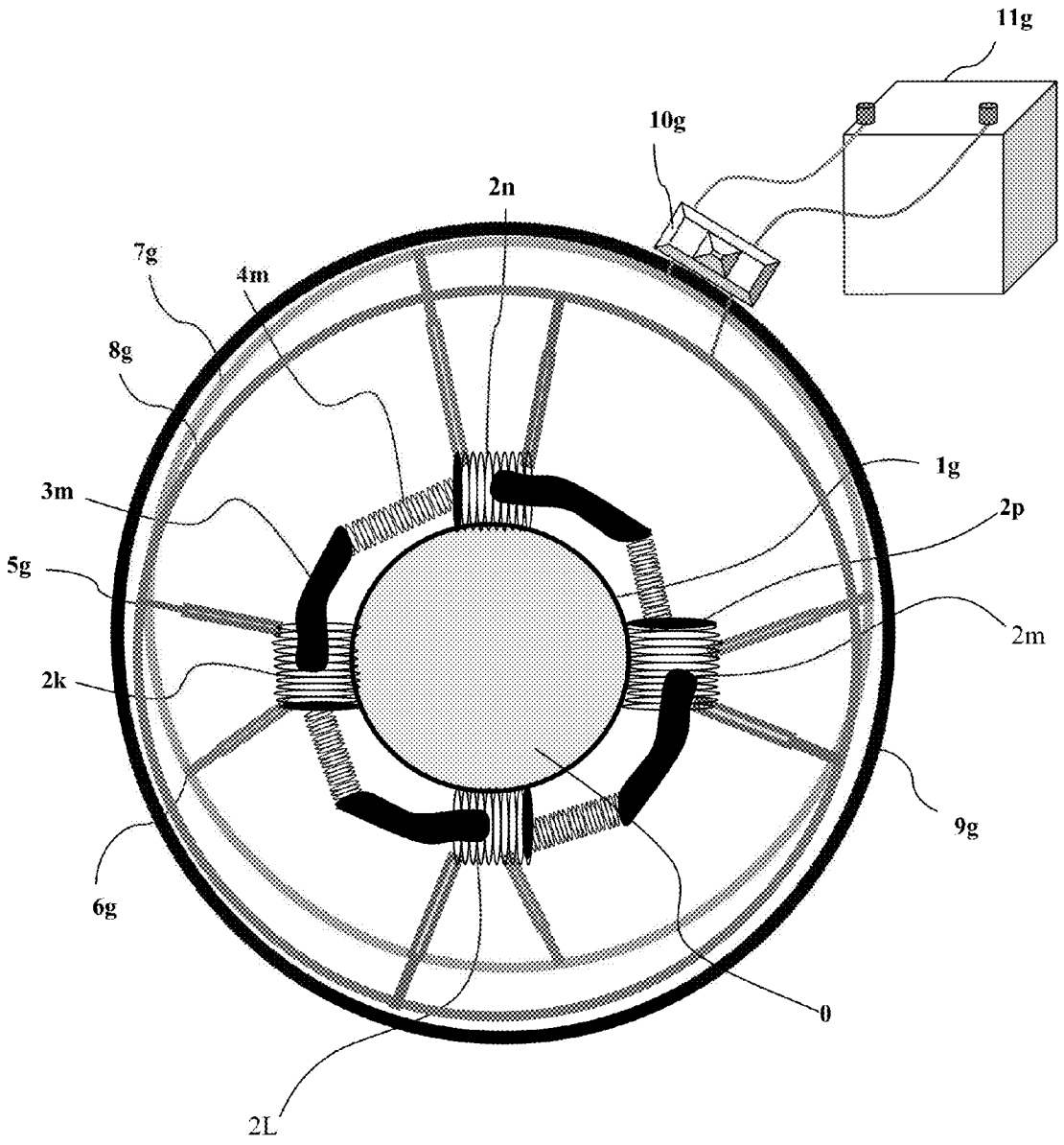
FIG. 10 Shows a "converse" design modifications of FIG. 1, wherein, a set of permanent magnets, residing inside a set of hollow metallic wire coils, both of which are attached to the compression spring, and all of which are arranged around a pipe, to make the for a novel electricity generator pipe system, entity. Shown, also, are the electrodes, encasing, wires, Rectifier and a re-chargeable battery.

Now, in FIG. 1, a converse arrangement of the magnets, metallic wire coils, and springs, within the pipe pump system can yield an electricity generation device, as in FIG. 10. So, in FIG. 10, shown are such an arrangement, wherein, the magnets, 3*m*, are free riding inside the metallic wire coils, 2*n*, 2*m*, 2*k*, 2L, while being affixed to a spring (non conducting, compression type), 4*m*, on the other side. Note that the spring, 4*m*, is attached to the non-conducting base plate, 2*p*, of the metallic wire coils, 2*n*, 2*m*, 2*k*, 2L. Again, the magnets, 3*m*, the metallic coil, 2*n*, 2*m*, 2*k*, 2L, and the spring, 4*m*, are attached around the pipe, 1, and forms a closed loop configured entity, FIG. 10. The pipe and, or, the tube, 1, can be as thin (membrane like), or, large, with different shapes and sizes and can be made from countless different types of material. The metallic coils, 2*n*, 2*m*, 2*k*, 2L, will have negative and positive electrodes like structure coming out of it, 5*g* and 6*g*, which are affixed to the circular wire, 8*g* and 7*g*, FIG. 8. The whole apparatus is affixed to a stationary rigid and strong pipe like structure, 9*g*, onto which there is an attached Rectifier (that converts AC current to DC current), 10*g*, FIG. 10. The Rectifier, 10*g*, is connected to a rechargeable battery, 11*g*, FIG. 10. Thus, the apparatus above comprises the essential parts of an electricity generator pipe system device.

In the pipe electricity generator system of FIG. 10, any fluid or gas or semi solid or solid or even electromagnetic wave, 0, can be flowed into and out of the pipe, 1, not in a continuous manner but only, in a discontinuous, discrete, disjointed, "pulsatile", manner. The discrete quantum of fluid volume flowing in and out of the pipe, 1*g*, in a pulsatile manner, like water waves on the beach or ocean surface, can cause perturbative oscillatory movements of the pipe, 1*g*, at a given synchronous or asynchronous or random, frequency or periodicity, FIG. 10. That perturbative oscillatory movement (or, ballooning in and out), of the pipe, 1*g*, surface will causes the magnets, 3*m*, and the metallic wire coils, 2*n*, 2*m*, 2*k*, 2L, on the surface of the pipe to move in and out of each other, as well, thence, causing the production of electricity within the metallic wire coils, 2*n*, 2*m*, 2*k*, 2L, as dictated by the Faraday Law of Electromotive Force (EMF) generation. The current generated by the coils, 2*n*, 2*m*, 2*k*, 2L, will be siphoned off by the electrodes, 5*g*, 6*g*, and the wires, 7*g*, 8*g*, and sent into the Rectifier, 10*g*, FIG. 10. From the Rectifier, 10*g*, the current will be supplied into an uncharged battery, 11*g*, which will be recharged. Henceforth, this embodiment of the pipe generator system, which is the inverse arrangement of the pipe pump system, will act as a producer and generator of electricity as long as perturbative, pulsatile, discontinuous, flow, pressure and volume of fluids in present within the pipe, 1, FIG. 10.

Similarly, in FIG. 9, the perturbative oscillatory discontinuous flow, pressure, and volume of fluids within the pipe, 1, can set off the generation of current within the piezoelectric crystal system, as well. This system will be the inverse of the piezoelectric crystal pipe pump system of FIG. 9, wherein, the perturbative vibration of the fluids, 0, within the pipe, 1, will cause the perturbative vibration in the "piezoelectric crystal", which in turn will generate electricity to be siphoned off to power any number of electricity needing system.

Figure 11:
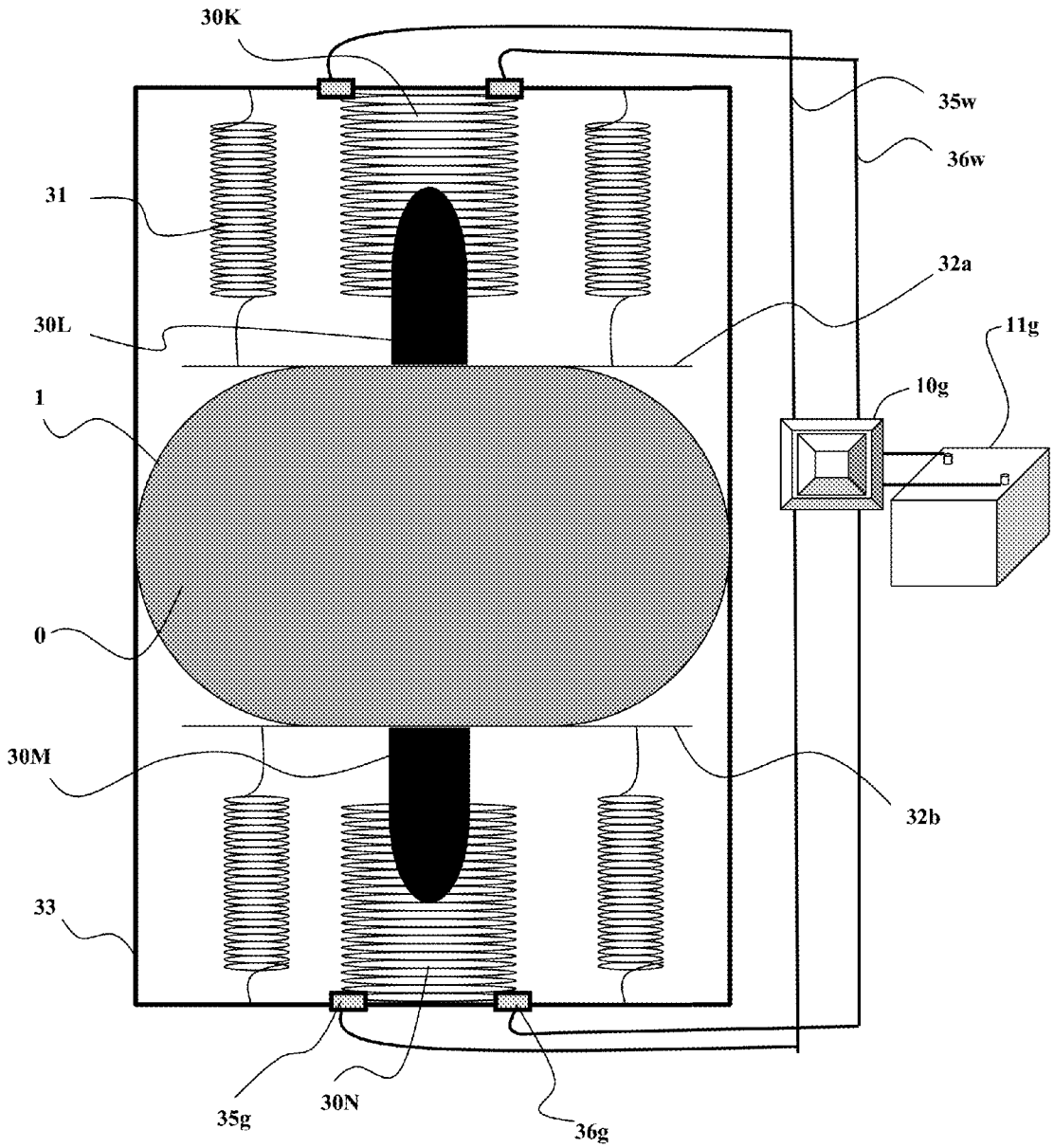
FIG. 11 Shows a "converse" design modifications of FIG. 6, wherein, one set of electromagnet coil windings, are replaced with permanent magnets, which are free riding inside a set of hollow metallic wire coils, which in turn replaces the other set of electromagnet coil windings. The perturbative motion of fluids inside the flexible pipe, causes the perburbative motion of the said pipe as well as the surrounding permanent magnets, which in turn interacts electromagnetically with the set of metallic wire coils to generate electricity; that is siphoned away, thus, forming the embodiment of the electricity generator pipe system.

In the same way, FIG. 11, demonstrates reconfiguration of FIG. 6, pipe pump system, such that electricity is generated from the rearranged magnets and metallic wire coils. The metallic coils of wire are, 30K, 30N, inside which lies the free riding permanent magnets, 30L, 30M, respectively, as in FIG. 11. The magnets, 30L, 30M, are attached to the non-conducting base plate, 32*a*, 32*b*, which in turn is fused to the outer surface of the flexible pipe, or, a thin membrane like tube, 1, FIG. 11. The plates, 32*a*, 32*b*, are affixed to the springs (compression type), 31, which is sequentially affixed to the rigid strong encasing, 33, FIG. 11. The metallic entities, 35*g*, 36*g*, affixes to the metallic wire coils, 30K, 30N, and helps carry away generated current into the Rectifier, 10*g*, which in turn is connected to the re-chargeable battery, 11*g*, FIG. 11.

So, when the perturbative, or, the pulsatile, or, the discontinuous, or, the discrete, flow, pressure, and volume, of any given fluid or gas, interacts with the flexible pipe (or, tubular membrane), 1, then, that perturbation is transmitted into the magnets, 30L, 30M, via the fused plate, 32*a*, 32*b*, as in FIG. 11. Henceforth, the perturbed movements of the magnet, 30L, 30M, inside the metallic wire coils, 30K, 30N, causes the generation of electricity by Faradays Law of Electromotive Force generation, inside the said metallic wire coils, 30K, 30N, FIG. 11. That generated current is siphoned away by the metallic entities, 35*g*, 36*g*, via the wire, 35*w*, 36*w*, into the Rectifier, 10*g*, FIG. 11. The Rectifier, 10*g*, supplies the generated electricity into the rechargeable battery, 11*g*, thus, recharging it, FIG. 11. Again, the converse arrangements of the actuators in the pipe pump system of FIG. 6, together with the perturbative flow of fluids inside the said pipe, 1, yields the desired production of electricity in this embodiment of the novel electricity generator pipe system, FIG. 11.

It will be appreciated that variations of the above-disclosed and other features and functions, or alternatives thereof, may be desirably combined into many other different pipe pump systems, electricity generator pipe systems, pipe pump applications, electricity generator pipe system applications, and, or, combinations, thereof. Also, that various presently unforeseen or unanticipated alternatives, modifications, variations or improvements therein may be subsequently made by those skilled in the art.

The invention claimed is:

1. A pipe pump system comprising:

a flexible pipe; and a magnet-coil assembly having a plurality of magnets and coils in proximity to the pipe, wherein each of the coils makes contact with an exterior surface of the flexible pipe, and wherein each of the coils is spaced-apart from an adjacent coil and non-concentrically overlays a portion of the flexible pipe;

wherein energizing and de-energizing of the magnet-coil assembly causes the magnet-coil assembly to contract against an outer surface of the flexible pipe and to move away from the outer surface of the flexible pipe, such that a pumping action is transmitted into the flexible pipe for causing movement of fluid within the flexible pipe.

2. The system according to claim 1, wherein each of the plurality of magnets is circularly configured, and connected at at least one end to a spring.

3. The system according to claim 1, further comprising a positive and a negative wire terminal each encircling the plurality of magnets.

4. The system according to claim 3, wherein the wire terminals are electrically connected to a power source and to the coils for powering the coils of the magnet-coil assembly.

5. The system according to claim 3, wherein the wire terminals are affixed to a non-conducting cylindrical housing.

6. The system according to claim 1, further comprising at least one valve at an end of the flexible pipe.

7. The system according to claim 6, wherein the at least one valve opens and closes according to the pumping action.

8. The system according to claim 1, wherein the flexible pipe is a flexible rubber tube pipe.

9. The system according to claim 1, further comprising a cooling system for cooling the flexible pipe.

10. The system according to claim 1, further comprising a turbine or a fan with blades positioned within the flexible pipe and configured to rotate.

11. The system according to claim 1, further comprising a piezoelectric crystal positioned at the outer surface of the flexible pipe, said piezoelectric crystal powered by a power source for activating said piezoelectric crystal and generating vibrations therefrom.

12. The system according to claim 1, further comprising a rectifier positioned at the outer surface of the flexible pipe and electrically connected to a power source.

* * * * *